US010249937B2

(12) United States Patent
Jin et al.

(10) Patent No.: US 10,249,937 B2
(45) Date of Patent: Apr. 2, 2019

(54) ELECTRONIC DEVICE ANTENNA WITH SUPPRESSED PARASITIC RESONANCE

(71) Applicant: Apple Inc., Cupertino, CA (US)

(72) Inventors: Nanbo Jin, Milpitas, CA (US); Anand Lakshmanan, San Jose, CA (US); Christopher T. Cheng, Sunnyvale, CA (US); Erica J. Tong, Pacifica, CA (US); Han Wang, Cupertino, CA (US); Mattia Pascolini, San Francisco, CA (US); Scott A. Myers, San Francisco, CA (US); Xu Gao, Santa Clara, CA (US); Richard H. Dinh, San Jose, CA (US); Tang Yew Tan, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 178 days.

(21) Appl. No.: 15/257,542

(22) Filed: Sep. 6, 2016

(65) Prior Publication Data

US 2018/0069297 A1 Mar. 8, 2018

(51) Int. Cl.

| | |
|---|---|
| ***H01Q 1/24*** | (2006.01) |
| ***H01Q 1/22*** | (2006.01) |
| ***H01Q 1/38*** | (2006.01) |
| ***H01Q 9/42*** | (2006.01) |
| ***H01Q 5/328*** | (2015.01) |

(52) U.S. Cl.

CPC ..... *H01Q 1/243* (2013.01); *H01Q 1/2291* (2013.01); *H01Q 1/38* (2013.01); *H01Q 5/328* (2015.01); *H01Q 9/42* (2013.01)

(58) Field of Classification Search

CPC ..... H01Q 1/243; H01Q 1/38; H01Q 1/2291; H01Q 9/42; H01Q 5/328

See application file for complete search history.

(56) References Cited

U.S. PATENT DOCUMENTS 8,105,094 B2 1/2012 Patel et al.
8,704,725 B2 4/2014 Xu et al.
(Continued)

FOREIGN PATENT DOCUMENTS

WO 2010122220 A1 10/2010

*Primary Examiner* — Hoang V Nguyen
*Assistant Examiner* — Awat M Salih
(74) *Attorney, Agent, or Firm* — Treyz Law Group, P.C.; G. Victor Treyz; Joseph F. Guihan

(57) ABSTRACT

An electronic device may be provided with wireless circuitry. The wireless circuitry may include one or more antennas. The antennas may include cellular telephone antennas, wireless local area network antennas, antenna structures for receiving satellite navigation system signals, and other antennas. An antenna may have an antenna resonating element such as an inverted-F antenna resonating element. The inverted-F antenna resonating element may have an inverted-F antenna resonating element arm formed from metal traces on a flexible printed circuit. The flexible printed circuit may be soldered to an antenna grounding clip. A screw may attach the clip, a speaker tab, a connector bracket, and other metal structures to a metal device housing that serves as ground for the antenna. The screw may be isolated from the antenna grounding clip and the other metal structures by an insulating structure such as an insulating gasket.

19 Claims, 7 Drawing Sheets

(56) References Cited

U.S. PATENT DOCUMENTS

| | | | | |
|---|---|---|---|---|
| 8,816,927 | B2 * | 8/2014 | Nakano | H01Q 1/2266 343/702 |
| 9,270,015 | B2 | 2/2016 | Harper | |
| 2006/0197705 | A1 | 9/2006 | Chen et al. | |
| 2008/0165064 | A1 * | 7/2008 | Hill | H01Q 1/243 343/702 |
| 2008/0316121 | A1 * | 12/2008 | Hobson | H01Q 1/243 343/702 |
| 2012/0050114 | A1 * | 3/2012 | Li | H01Q 1/2266 343/702 |

* cited by examiner

ELECTRONIC DEVICE ANTENNA WITH SUPPRESSED PARASITIC RESONANCE

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It can be challenging to incorporate wireless communications circuitry into electronic devices. If care is not taken, a device may be made overly large to accommodate wireless circuitry or wireless performance may not be satisfactory.

SUMMARY

An electronic device may be provided with wireless circuitry. The wireless circuitry may include one or more antennas. The antennas may include cellular telephone antennas, wireless local area network antennas, antenna structures for receiving satellite navigation system signals, and other antennas.

An antenna may have an antenna resonating element such as an inverted-F antenna resonating element. The inverted-F antenna resonating element may have an inverted-F antenna resonating element arm formed from metal traces on a flexible printed circuit. The flexible printed circuit may be soldered to an antenna grounding clip. A screw may attach the clip, a speaker grounding tab, a connector grounding bracket, and other metal structures to a metal device housing that serves as an antenna ground for the antenna.

The clip, speaker grounding tab, connector grounding bracket, and other metal structures may form a return path in the antenna. The return path may be coupled between the resonating element arm and the antenna ground in parallel with an antenna feed. The screw may be isolated from the antenna grounding clip and the other metal structures by an insulating structure such as an insulating gasket. The insulating structure may be used to prevent formation of an undesired parasitic antenna path through the screw to the antenna ground that could degrade antenna performance.

DETAILED DESCRIPTION

Figure 1:
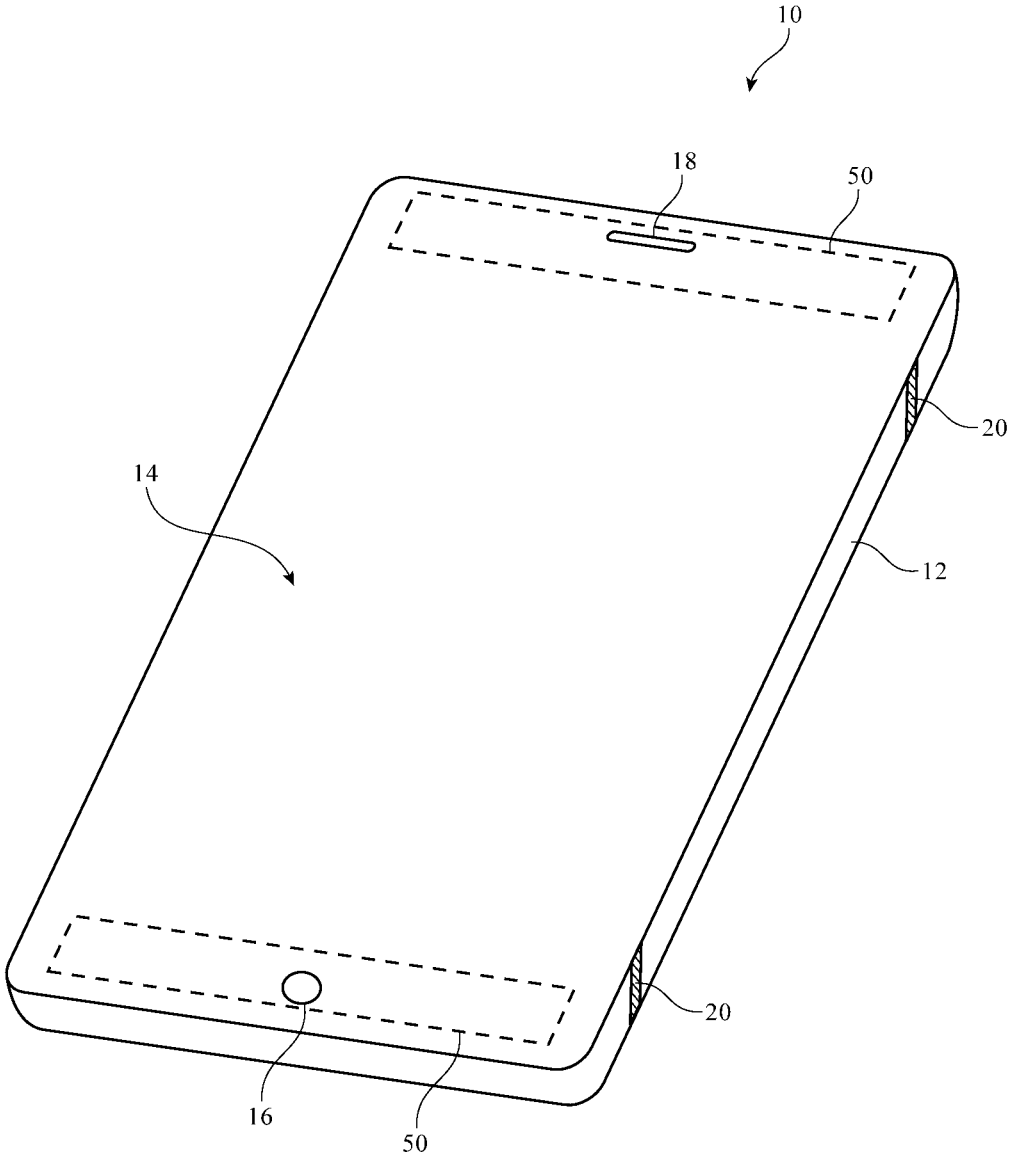
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include cellular telephone antennas, wireless local area network antennas (e.g., WiFi® antennas at 2.4 GHz and 5 GHz and other suitable wireless local area network antennas), satellite navigation system signals, millimeter wave communications, and near-field communications antennas.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 14. Display 14 may be mounted in a housing such as housing 12. For example, device 10 may have opposing front and rear faces and display 14 may be mounted in housing 12 so that display 14 covers the front face of device 10 as shown in FIG. 1. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). If desired, different portions of housing 12 may be formed from different materials. For example, housing sidewalls may be formed from metal and some or all of the rear wall of housing 12 may be formed from a dielectric such as plastic, glass, ceramic, sapphire, etc. Dielectric rear housing wall materials such as these may, if desired, by laminated with metal plates and/or other metal structures to enhance the strength of the rear housing wall (as an example).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of pixels formed from liquid crystal display (LCD) components, an array of electrophoretic pixels, an array of plasma pixels, an array of organic light-emitting diode pixels, an array of electrowetting pixels, or pixels based on other display technologies.

Display 14 may be protected using a display cover layer such as a layer of transparent glass, clear plastic, sapphire, or other transparent dielectric. Openings may be formed in the display cover layer. For example, an opening may be formed in the display cover layer to accommodate a button such as button 16. Buttons such as button 16 may also be formed from capacitive touch sensors, light-based touch sensors, or other structures that can operate through the display cover layer without forming an opening.

If desired, an opening may be formed in the display cover layer to accommodate a port such as speaker port 18. Openings may be formed in housing 12 to form communications ports (e.g., an audio jack port, a digital data port, etc.). Openings in housing 12 may also be formed for audio components such as a speaker and/or a microphone. Dielectric-filled openings 20 such as plastic-filled openings may be formed in metal portions of housing 12 such as in metal sidewall structures (e.g., to serve as antenna windows and/or to serve as gaps that separate portions of antennas from each other). Openings such as opening 20 of FIG. 1 may extend across the rear wall of housing 12.

Antennas may be mounted in housing 12. If desired, some of the antennas may be mounted under dielectric portions of device 10 (e.g., portions of the display cover layer, portions of a plastic antenna window in a metal housing sidewall portion of housing 12, etc.). Antennas may also be formed from metal portions of housing 12.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing, along the peripheral edges of housing 12, on the rear of housing 12, under the display cover layer that is used in covering and protecting display 14 on the front of device 10 (e.g., a glass cover layer, a sapphire cover layer, a plastic cover layer, other dielectric cover layer structures, etc.), under a dielectric window on a rear face of housing 12 or the edge of housing 12, under a dielectric rear wall of housing 12, or elsewhere in device 10. As an example, antennas may be mounted at one or both ends 50 of device 10 (e.g., along the upper and lower edges of housing 12, at the corners of housing 12, etc.).

Figure 2:
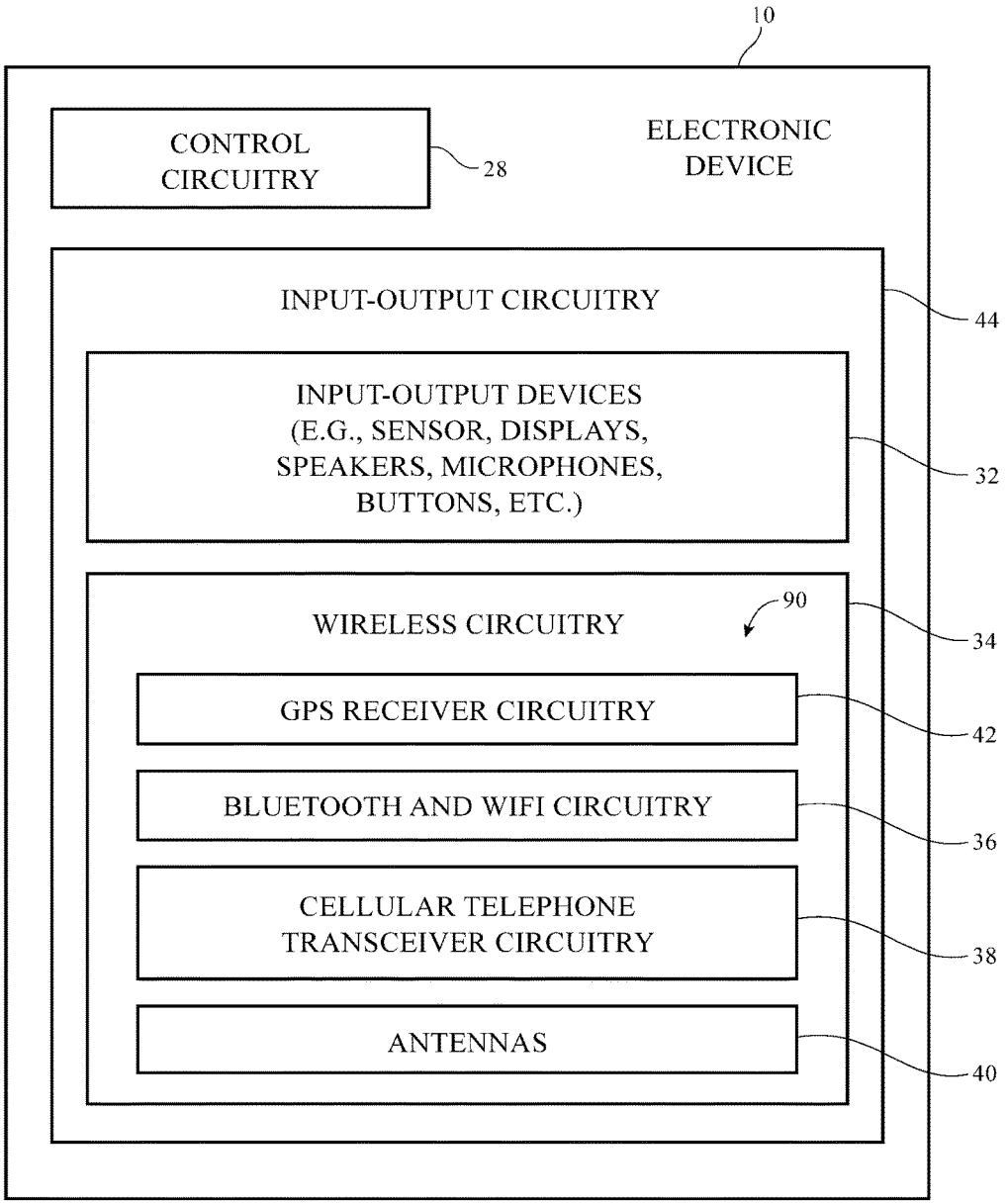
FIG. 2 is a schematic diagram of an illustrative electronic device with wireless communications circuitry in accordance with an embodiment.

A schematic diagram of illustrative components that may be used in device 10 is shown in FIG. 2. As shown in FIG. 2, device 10 may include storage and processing circuitry such as control circuitry 28. Control circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 28 may be used to control the operation of device 10. This processing circuitry may be based on one or more microprocessors, microcontrollers, digital signal processors, baseband processor integrated circuits, application specific integrated circuits, etc.

Control circuitry 28 may be used to run software on device 10, such as internet browsing applications, voice-over-internet-protocol (VOW) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, satellite navigation system protocols, millimeter wave communications protocols, etc.

Device 10 may include input-output circuitry 44. Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42.

Transceiver circuitry 36 may be wireless local area network transceiver circuitry. Transceiver circuitry 36 may handle 2.4 GHz and 5 GHz bands for WiFi® (IEEE 802.11) communications and may handle the 2.4 GHz Bluetooth® communications band.

Circuitry 34 may use cellular telephone transceiver circuitry 38 for handling wireless communications in frequency ranges such as a communications band from 700 to 960 MHz, a band from 1710 to 2170 MHz, a band from 2300 to 2700 MHz, other bands between 700 and 2700 MHz, higher bands such as LTE bands 42 and 43 (3.4-3.6 GHz), or other cellular telephone communications bands. Circuitry 38 may handle voice data and non-voice data.

Wireless communications circuitry 34 may include satellite navigation system circuitry such as Global Positioning System (GPS) receiver circuitry 42 for receiving GPS signals at 1575 MHz or for handling other satellite positioning data (e.g., GLONASS signals at 1609 MHz). Satellite navigation system signals for receiver 42 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. If desired, device 10 may include millimeter wave wireless transceiver circuitry. To enhance signal reception for millimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, inverted-F antenna structures, slot antenna structures, planar inverted-F antenna structures, monopoles, dipoles, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals).

In configurations for device 10 in which housing 12 has portions formed from metal, openings may be formed in the metal portions to accommodate antennas 40. For example, openings in a metal housing wall may be used in forming splits (gaps) between resonating element structures and ground structures in cellular telephone antennas. These openings may be filled with a dielectric such as plastic. As shown in FIG. 1, for example, portions of plastic-filled openings 20 may run up one or more of the sidewalls of housing 12.

Figure 3:
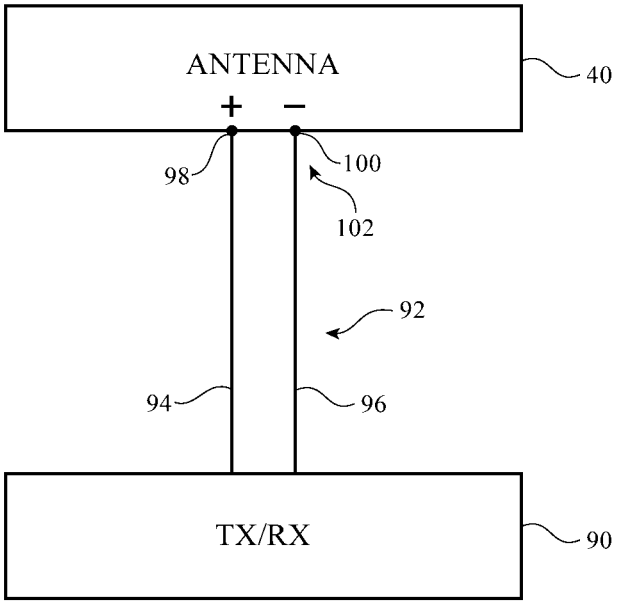
FIG. 3 is a diagram of an illustrative transceiver circuit and antenna in accordance with an embodiment.

A schematic diagram of a wireless local area network antenna or other antenna 40 coupled to transceiver circuitry 90 (e.g., wireless local area network transceiver 36 and/or other transceiver circuitry 90) is shown in FIG. 3. As shown in FIG. 3, radio-frequency transceiver circuitry 90 may be coupled to antenna feed 102 of antenna 40 using transmission line 92. Antenna feed 102 may include a positive antenna feed terminal such as positive antenna feed terminal 98 and may have a ground antenna feed terminal such as ground antenna feed terminal 100. Transmission line 92 may be formed form metal traces on a printed circuit or other conductive structures and may have a positive transmission line signal path such as path 94 that is coupled to terminal 98 and a ground transmission line signal path such as path 96 that is coupled to terminal 100. Transmission line paths such as path 92 may be used to route antenna signals within device 10. For example, transmission line paths may be used to couple antenna structures such as one or more antennas in an array of antennas to transceiver circuitry 90. Transmission lines in device 10 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within transmission line 92 and/or circuits such as these may be incorporated into antenna 40 (e.g., to support antenna tuning, to support operation in desired frequency bands, etc.).

Device 10 may contain multiple antennas 40. The antennas may be used together or one of the antennas may be switched into use while other antenna(s) are switched out of use. If desired, control circuitry 28 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

Figure 4:
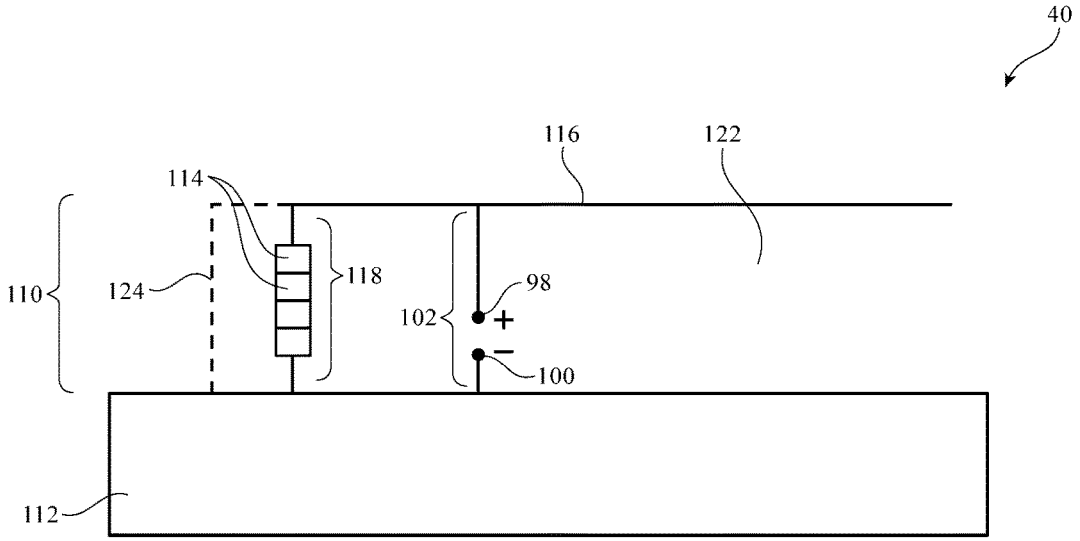
FIG. 4 is a diagram of an illustrative antenna in accordance with an embodiment.

FIG. 4 is a diagram of an illustrative antenna that may be used in device 10. In the example of FIG. 4, antenna 40 is an inverted-F antenna. Antenna 40 of FIG. 4 may be used in forming a wireless local network antenna or other suitable antenna in device 10.

As shown in FIG. 4, antenna 40 may include an antenna resonating element such as antenna resonating element 110 and an antenna ground such as antenna ground 112. Antenna resonating element 110 may have one or more branches such as antenna resonating element arm 116. Return path 118 (sometimes referred to as a short circuit path) may be coupled between resonating element arm 116 and ground 112. If desired, return path 118 may include a stack of conductive structures 114 (e.g., brackets, flexible printed circuit traces, etc.). Antenna feed 102 may include positive antenna feed terminal 98 and ground antenna feed terminal 100 and may be coupled between element 110 (e.g., arm 116) and ground 112 in parallel with return path 118. One or more optional components (switches, tunable circuits such as tunable capacitors, tunable inductors, etc.) may be coupled between antenna ground 112 and resonating element arm 116 and may be adjusted to tune antenna 40. The configuration of FIG. 4 in which no tunable components are coupled between arm 116 and ground 112 is merely illustrative.

Antenna resonating element arm 116 may be separated from ground 112 by dielectric opening 122. If desired, opening 122 may form a slot antenna element that contributes to the antenna response of antenna 40. In the example of FIG. 4, antenna 40 is an inverted-F antenna that does not include a slot antenna element.

Antennas such as antenna 40 of FIG. 4 (e.g., inverted-F antennas, slot antennas, hybrid inverted-F slot antennas, etc.) and/or other types of antenna (e.g., patch antennas, loop antennas, etc.) may be used in supporting cellular telephone communications, wireless local area network communications (e.g., communications at 2.4 and 5 GHz, etc.) and/or other wireless communications.

Screws and other fasteners may, if desired, be used to help couple the conductive structures of antenna 40 to ground 112. For example, a screw or other fastener may be used to mount a ground portion of antenna 40 in a configuration that shorts the ground portion of antenna 40 to an antenna ground plane. The antenna ground plane may, for example, be formed from a metal housing such as electronic device housing 12.

If care is not taken, the presence of the screws may create an undesired parasitic antenna structure that degrades the performance of antenna 40 (e.g., by creating a parasitic resonating mode with an undesired frequency response). For example, there may be a risk that a screw or other fastener might create an undesired parasitic such as parasitic path (structure) 124 between arm 116 and ground 112 that degrades antenna performance. To minimize or eliminate this possibility, the screw or other fastener that is associated with potential path 124 may be electrically isolated from the other structures of resonating element 110 (e.g., arm 116, structures 114, and/or other portions of antenna 40). Isolating the screw or other fastener in this way may help ensure that antenna 40 operates satisfactorily.

Antennas 40 may be formed from sheet metal parts (e.g., strips of sheet metal embedded in molded plastic or attached to dielectric supports using adhesive, etc.), may be formed from wires, may be formed from portions of conductive housing structures (e.g., metal walls in housing 12), and/or may be formed from conductive structures such as metal traces on a printed circuit or other substrate. Printed circuits in device 10 may be rigid printed circuit boards formed from rigid printed circuit board substrate material (e.g., fiberglass-filled epoxy) and/or may be flexible printed circuit boards (e.g., printed circuits formed from sheets of polyimide or other flexible polymer layers). In some configurations, antenna substrates may be formed from other dielectrics (e.g., ceramics, glass, etc.).

Figure 5:
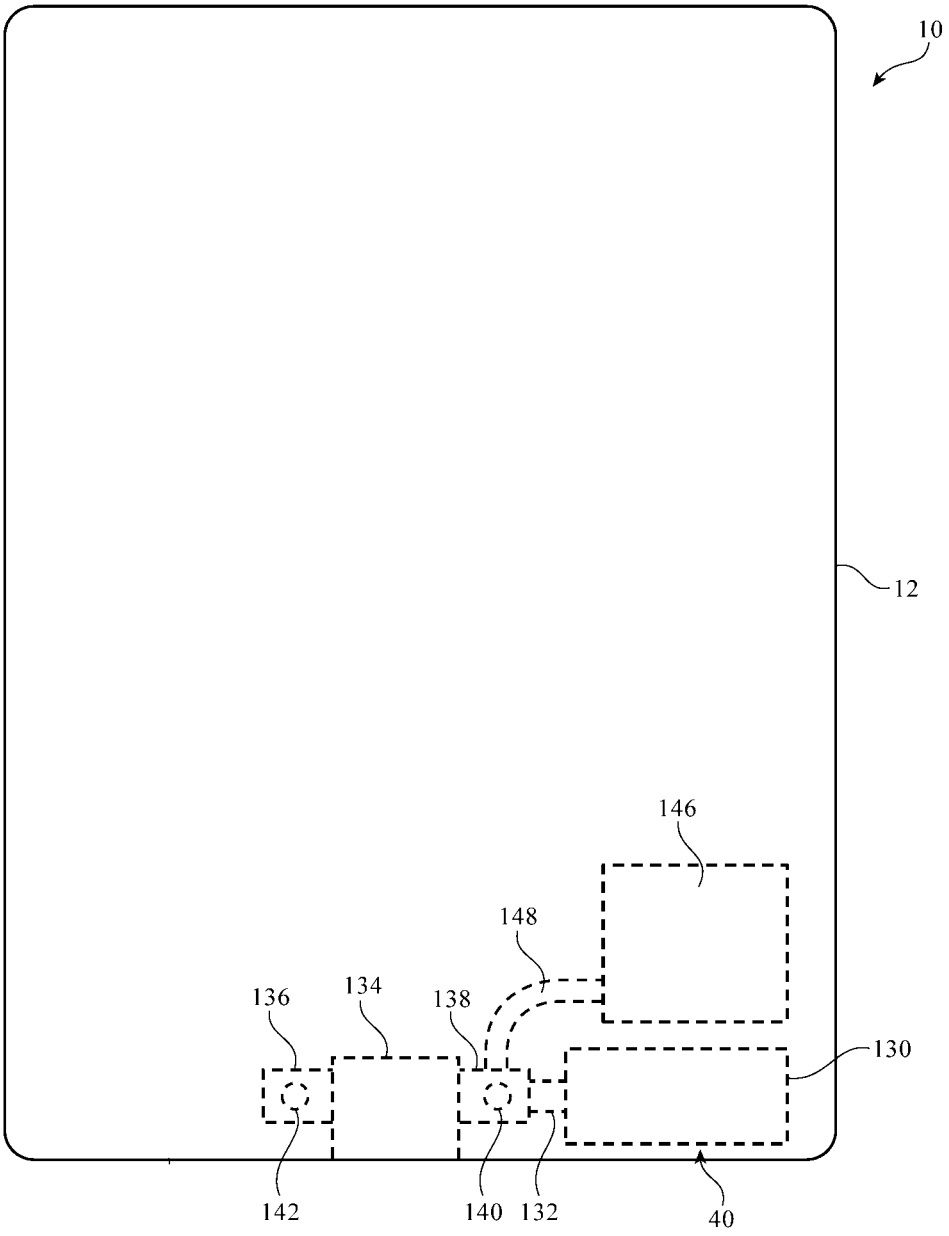
FIG. 5 is a top view of an illustrative electronic device with an antenna in accordance with an embodiment.

FIG. 5 is a top view of an illustrative electronic device such as device 10 of FIG. 1 that includes an antenna. As shown in FIG. 5, antenna 40 may be located in the lower right corner 130 of housing 12 (as an example). In this location, antenna 40 may be mounted adjacent to a connector such as connector 134. Connector 124 may have contacts that mate with corresponding contacts on a cable or other accessory. Connector 134 may have metal parts (e.g., metal supporting and shielding structures, such as brackets 136 and 138. Fasteners such as screws 142 and 140 may be used to couple portions of connector 134 such as brackets 136 and 138 to housing 12. This may serve to ground brackets 136 and 138 and thereby may ground portions of connector 134 (e.g., shielding structures in connector 134).

Device 10 may include electrical components such as component 146. Component 146 may be, for example, a speaker or other audio component. Component 146 may include sheet metal structures and/or other metal structures. These structures in component 146 may be grounded to housing 12 using speaker grounding tab 148. Screw 140 may be used to mount grounding tab 148 to housing 12.

Figure 6:
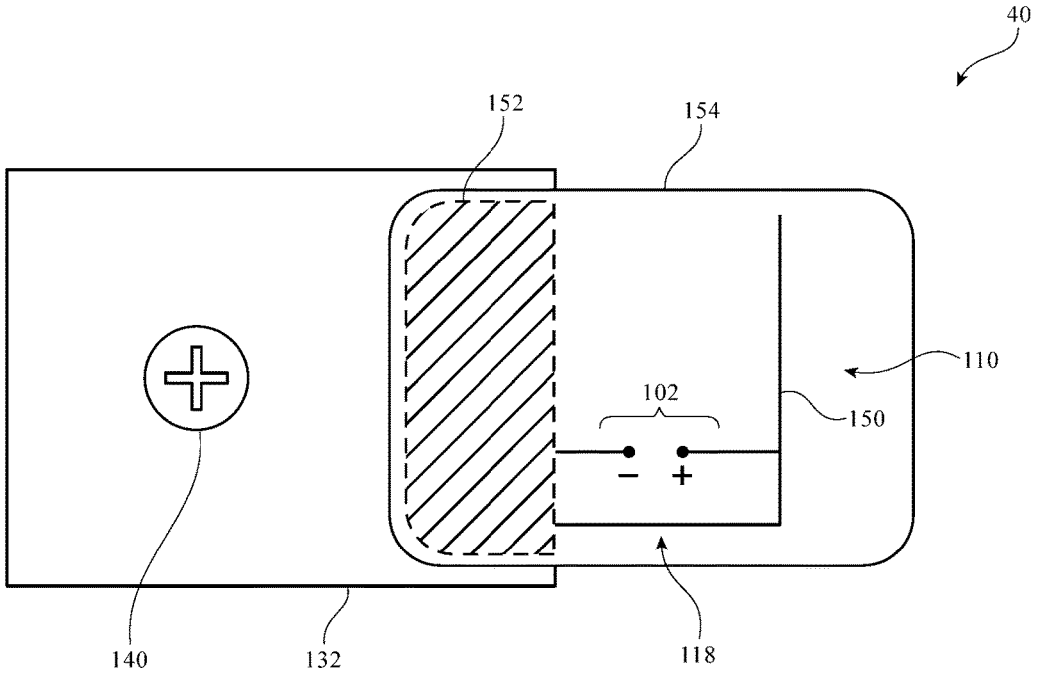
FIG. 6 is a top view of an illustrative antenna for an electronic device in accordance with an embodiment.

Antenna 40 may have conductive structures such as antenna grounding clip 132 (sometimes referred to as an antenna clip, wireless local area network antenna clip, etc.). Antenna grounding structures such as grounding clip 132 may also be coupled to housing 12 using screw 140. A top view of antenna 40 and screw 140 is shown in FIG. 6. As shown in FIG. 6, antenna 40 may include metal traces 150 on flexible printed circuit 154 that are patterned to form antenna resonating element 110. Antenna clip 132 may be formed from a metal member such as a sheet metal member that is attached to device 10 using screw 140 (e.g., so that clip 132 is shorted to the antenna ground formed from housing 12). Solder 152 may be used to short ground traces in traces 150 to clip 132. Return path 118 may be formed from portions of traces 150, solder 152, antenna clip 132, and other conductive structures (see, e.g., structures 114 of FIG. 5) that are coupled to housing 12 in the vicinity of screw 140. Screw 140 may be electrically isolated from clip 132 so as not to form undesired parasitic path 124 in parallel with return path 118.

Figure 7:
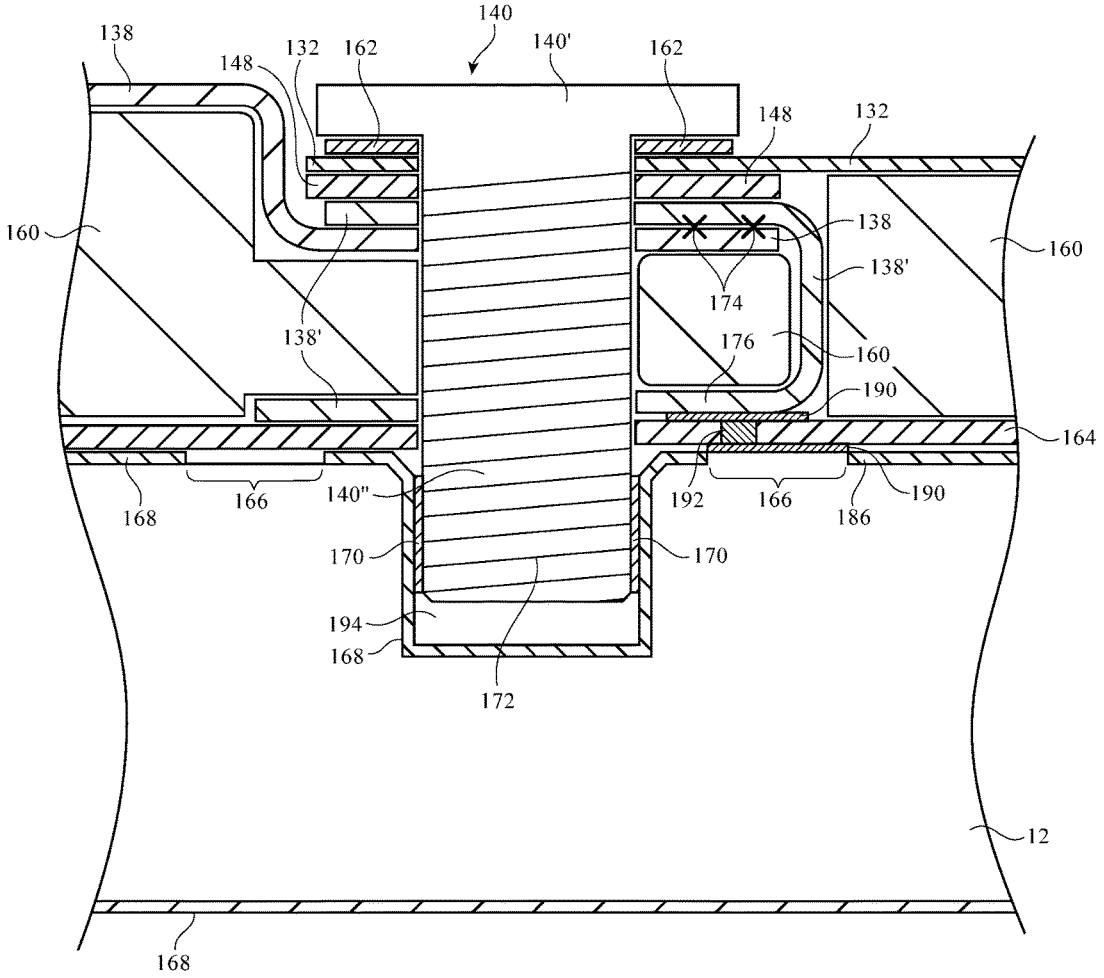
FIG. 7 is a cross-sectional side view of an illustrative grounding arrangement for an electronic device antenna in accordance with an embodiment.

A cross-sectional side view of screw 140 and associated structures that are being mounted to housing 12 using screw 140 are shown in FIG. 7. As shown in FIG. 7, screw 140 may be used to couple connector bracket 138 to housing 12. Screw 140 may pass through an opening in bracket 138 and may hold bracket 138 against structure 160 (e.g., plastic support structures and/or other structures in device 160 that can support bracket 138). Connector clip 138' may be welded to bracket 138 using welds 174. At lower portion 176 of clip 138', clip 138' may be electrically coupled to housing 12 in region 166 through flexible printed circuit 164.

Flexible printed circuit 164 may have metal traces that supply signals to connector 134 of FIG. 5 and/or may be associated with other components in device 10. Flexible printed circuit 164 may be formed from a layer of polyimide or other flexible dielectric substrate material. As shown in FIG. 7, flexible printed circuit 164 may have metal traces such as pads 190 and via 192 that electrically couple clip 138' to housing 12 in region 166.

With an arrangement of the type shown in FIG. 7, speaker mounting tab 148 (FIG. 5) may be pressed against bracket 138 by downward pressure from screw 140. This shorts tab 148 to bracket 138. Antenna grounding clip 150 may be pressed against speaker mounting tab 148 by downward pressure from screw 140 and may be shorted to bracket 138 through tab 148. The structures of FIG. 7 thereby ground antenna clip 150 to housing 12 (i.e., clip 150, tab 148, clip 138', bracket 138, traces 190 and 192 in flexible printed circuit 164 form conductive structures 114 of return path 118 of antenna 40 of FIG. 4).

Housing 12 may be formed from a metal such as aluminum. The surface of housing 12 may be anodized to form a thin protective anodized coating (e.g., aluminum oxide) such as coating 168. This protective coating is insulating and may be formed on the inner and outer surfaces of housing 12 including within threaded screw hole 194. To ensure that traces 190 of flexible printed circuit 164 make satisfactory ohmic contact to housing 12, anodized coating 168 may be selectively removed in region 166 (e.g., by chemical etching, laser removal, etc.) to expose bare aluminum (or other metal) that forms housing 12. Screw 140 may have threads 172 that are received by making threads in threaded screw hole 194. Thread locking compound 170 may be use to help hold screw 140 in place within hole 194.

The arrangement of FIG. 7 helps ground antenna 40 be forming return path 118 to housing 12, which serves as antenna ground 112. If desired, more metal structures or fewer metal structures may be used in forming path 118 between arm 116 of antenna 40 and ground 112. The configuration of FIG. 7 is merely illustrative.

In some situations, screw 140 may be electrically isolated from housing 12 due to the presence of anodized coating 168 and thread locking compound 170. In other situations, screw 140 may break through portions of coating 168 and thread locking compound 170, so that screw 140 is electrically shorted to housing 12. However, in situations in which screw 140 is not shorted to housing 12 due to the presence of anodized coating 168, there is a risk that screw 140 may serve as undesired parasitic antenna structure 124 of FIG. 4. In this type of scenario, screw 140 may give rise to a parasitic antenna resonance that degrades antenna performance.

To ensure that screw 140 does not form undesired parasitic structure 124 of FIG. 4, screw 140 may be electrically isolated from antenna 40 by interposing insulating layer 162 between head 140' of screw 140 and antenna grounding clip 132. Insulating layer 162 may be formed from an injection molded polymer coating on grounding clip 150, may be formed from a sprayed polymer coating, a dipped polymer coating, or other dielectric coating layer on clip 150, may be formed from a polymer member, a dielectric gasket, or other insulating member (e.g., a circular ring-shaped dielectric gasket formed from a dielectric such as polyimide or other polymer), or may be formed from other suitable insulating structures. In the absence of an insulating structure between clip 150 and head 140' of screw 140 such as insulating layer 162, there will be a risk that antenna currents can flow in shaft 140" of screw 140 (i.e., screw 140 may act as undesired parasitic antenna structure 124). In the presence of insulating structure such as insulating layer 162, head 140' and therefore screw 140 will be electrically isolated from clip 150 and will be electrically isolated from the rest of antenna 40 and will therefore not interfere with the operation of antenna 40.

The foregoing is merely illustrative and various modifications can be made to the described embodiments. The foregoing embodiments may be implemented individually or in any combination.

What is claimed is:

1. An electronic device, comprising:

an inverted-F antenna having an inverted-F antenna resonating element arm and having a grounding clip;

a metal housing that serves as antenna ground for the inverted-F antenna;

at least one metal structure that is electrically coupled to the metal housing and that forms at least a portion of a return path coupling the inverted-F antenna resonating element arm to the antenna ground;

a fastener that presses the grounding clip against the at least one metal structure; and an insulating structure interposed between a portion of the fastener and the grounding clip, wherein the housing comprises aluminum, has an anodized coating in a first region, and has a second region without any of the anodized coating to which the at least one metal structure is electrically coupled.

2. The electronic device defined in claim 1 wherein the insulating structure comprises a polymer structure.

3. The electronic device defined in claim 2 wherein the polymer structure comprises a coating on the grounding clip.

4. The electronic device defined in claim 2 wherein the polymer structure comprises a polymer gasket.

5. The electronic device defined in claim 1 wherein the fastener comprises a screw having a screw head, the insulating structure comprises a polymer member, and the polymer member is interposed between the screw head and the grounding clip.

6. The electronic device defined in claim 1 wherein the inverted-F antenna is configured to transmit and receive wireless local area network antenna signals.

7. The electronic device defined in claim 1 wherein the at least one metal structure comprises a speaker grounding tab.

8. The electronic device defined in claim 7 wherein the at least one metal structure comprises a metal member welded to a connector bracket.

9. The electronic device defined in claim 8 wherein the at least one metal structure comprises metal traces in a flexible printed circuit.

10. The electronic device defined in claim 9 wherein the metal traces contact the metal housing in the second region.

11. The electronic device defined in claim 1 wherein the at least one metal structure comprises a plurality of metal members interposed between the grounding clip and the second region.

12. The electronic device defined in claim 11 wherein one of the metal members comprises a metal clip.

13. The electronic device defined in claim 12 wherein the fastener comprises a screw having a head and having a threaded shaft that is received within a threaded hold in the metal housing.

14. The electronic device defined in claim 13 wherein the insulating structure is interposed between the head and the grounding clip.

15. Apparatus, comprising:

an antenna having a resonating element arm, an antenna ground, an antenna feed that is coupled between the resonating element arm and the antenna ground, and a return path that is coupled between the resonating element arm and the antenna ground in parallel with the antenna feed; and a metal structure having a screw hole;

a coating on the metal structure in the screw hole;

conductive structures that form the return path, wherein the conductive structures are shorted to a portion of the metal structure that is not covered by the coating;

a screw having a threaded shaft that is received within the screw hole and having a head, wherein the screw presses the conductive structures towards the metal structure; and an insulating gasket that electrically isolates the head from the conductive structures.

16. The apparatus defined in claim 15 wherein the conductive structures include an antenna grounding clip and the insulating gasket is interposed between the head and the antenna grounding clip.

17. The apparatus defined in claim 16 wherein the metal structure comprises a metal electronic device housing and the coating comprises an oxide coating.

18. An electronic device, comprising:

an antenna having an antenna ground and having an antenna grounding clip that is coupled to the antenna ground;

a metal housing that forms the antenna ground and that has a hole with an insulating coating and a region without the insulating coating;

an insulating member;

a plurality of conductive structures; and a fastener having a first portion that is received within the hole and having a second portion that is electrically isolated from the antenna grounding clip by the insulating member and that presses the antenna grounding clip against the plurality of conductive structures to short the antenna grounding clip to the region without the insulating coating through the plurality of conductive structures.

19. The electronic device defined in claim 18 further comprising:

a display mounted in the housing; and a speaker mounted to the housing using a speaker grounding tab that forms one of the plurality of conductive structures, wherein the antenna comprises a wireless local area network antenna.

* * * * *